US008158267B2

(12) United States Patent
Tacken et al.

(10) Patent No.: US 8,158,267 B2
(45) Date of Patent: Apr. 17, 2012

(54) METHOD FOR PARTIALLY METALLIZING A PRODUCT

(75) Inventors: Roland Anthony Tacken, Geldrop (NL); Franky Flory Vercauteren, Eindhoven (NL); Hendrik Rendering, Nieuwegein (NL)

(73) Assignee: Nederlandse Organisatie Voor Toegepast-Natuurwetenschappelijk Onderzoek TNO, Delft (NL)

( * ) Notice: Subject to any disclaimer, the term of this patent is extended or adjusted under 35 U.S.C. 154(b) by 860 days.

(21) Appl. No.: 11/992,339

(22) PCT Filed: Sep. 22, 2006

(86) PCT No.: PCT/NL2006/000472

§ 371 (c)(1),
(2), (4) Date: Oct. 9, 2008

(87) PCT Pub. No.: WO2007/035091

PCT Pub. Date: Mar. 29, 2007

(65) Prior Publication Data

US 2010/0143727 A1 Jun. 10, 2010

(30) Foreign Application Priority Data

Sep. 23, 2005 (EP) ..... 05077181

(51) Int. Cl.
*B32B 15/04* (2006.01)
*B32B 15/08* (2006.01)

(52) U.S. Cl. ..... 428/457; 427/97.2; 427/98.4; 427/304; 427/596; 427/597; 428/35.7; 428/461; 428/500; 428/626; 428/627; 522/67; 522/122; 528/61

(58) Field of Classification Search ..... 427/97.2, 427/98.4, 304, 596, 597; 428/35.7, 461, 428/500, 626, 627; 522/67, 122; 528/61
See application file for complete search history.

(56) References Cited

U.S. PATENT DOCUMENTS

| | | | |
|---|---|---|---|
| 4,077,853 | A | 3/1978 | Coll-Palagos |
| 2004/0009298 | A1 | 1/2004 | Moran et al. |

FOREIGN PATENT DOCUMENTS

| | | | |
|---|---|---|---|
| EP | 1 524 331 | A1 | 4/2005 |
| WO | WO 2005/035827 | A1 | 4/2005 |

OTHER PUBLICATIONS

Verbundfestigkeit von Thermoplasten bei der Zwei-Komponenten-MID-Technik fur miniaturisierte Mikrosystemgehause, Abschlussbericht FV-Nr. 12120N, Hahn-Schickard-Gesellschaft Institut fur Mikroaufbautechnik (2001).
Degussa product leaflet vestodur (2002).
G. Naundorf, H. Wissbrock, A fundamentally new mechanism for additive metallization of polymeric substrates in ultra fine line technology illustrated for 3D-MIDs, Galvanotechnik, 91, (2000) 9.
M. Huske, et al. Laser supported activation and additive metallization of thermoplastics for 3D-MIDs, Proc. 3rd LANE 2001, Erlangen (2001) Germany.

*Primary Examiner* — Terressa Boykin
(74) *Attorney, Agent, or Firm* — Weingarten, Schurgin, Gagnebin & Lebovici LLP

(57) ABSTRACT

A method for partially metallizing a product comprising a first surface, a first polymer material, and a second surface, a second polymer material, wherein the method comprises the sequential steps of exposing the first and second surfaces to conditions which render the first surface hydrophilic, and the second surface hydrophobic; contacting the first and second surfaces with water or aqueous solution; contacting the first and second surfaces with a solution of a film former in a water-immiscible solvent; evaporating the solvent to allow formation of a film by the film former on the second surface; adherence of a film by the film former on the first surface is prevented by the presence of the water or aqueous solution thereupon; performing a conventional metallization process to deposit a metal layer on the first and second surface; and removing the metallized film from the second surface to render the first surface metallized.

9 Claims, 2 Drawing Sheets

METHOD FOR PARTIALLY METALLIZING A PRODUCT

This application is a §371 national phase filing of PCT/NL2006/000472 filed Sep. 22, 2006, and claims priority to European application No. 05 077 181.5 filed Sep. 23, 2005.

FIELD

The present invention relates to a method for metallizing a product which comprises a first component, constituted by a first polymer material, and a second component, constituted by a second polymer material.

BACKGROUND

Conventional methods for metallizing non-conductors wet-chemically in general perform the following procedure:

1. Etching: to obtain a hydrophilic surface and roughing of the surface at micro scale to gain conditions for a good adherence;
2. Sensitizing: adsorption of $Sn^{2+}$ ions at the surface;
3. Activating: reduction of $Pd^{2+}$ to metallic Pd by the $Sn^{2+}$ ions;

Note: There is another process that is very often used to obtain Pd on the surface of the plastic, where step 2 and 3 are replaced by:

2') Nucleation: adsorption of Pd nanoparticles, stabilised by $Sn^{2+}$ ions, at the surface 3') Acceleration: removal of Sn ions from the surface of the Pd 4. Electroless metallizing: catalytic reduction of the metal to be applied (e.g. Cu or Ni) at Pd from a solution which comprises both the metal to be applied in ion form and a reductor.

The non-conductive substrate is thus nucleated (provided with nuclei or seed) of metallic Pd to which the relevant metal can be deposited.

In order to selectively metallize a product consisting of e.g. two types of plastic (i.e. one to be metallized, the other one not), without using a mask or the like, the required selectivity may be based upon chemical or physical processes. The problem, however, is that the Sn/Pd nucleation (forming of nuclei) in steps 2 and 3 always occurs at nearly all plastic surfaces, etched or not etched, in some extent, due to the strong adsorptive character. So it is not possible to select or modify a plastic (by etching, irradiating or other surface treatments) in such extent that during the process no metal precipitation occurs at all. It is indeed possible to reach important differences in adherence between the metal layers precipitated at two plastics, but removal of the metal layer in a mechanical way (e.g. ultrasonically) is difficult and will not yield the desired 100% selectivity. (see also [1]).

Although the metallization of plastics has been practiced for decades, selective metallization of compound plastic products is a recent technique, started by the emergence of technologies as MID, MEMS, 2K injection moulding and the pursuit of miniaturization and weight saving.

Besides additive metallization, there exist subtractive pattern methods at which the whole product is metallized and later on a part of it is removed by chemical, physical (plasma) or optical (laser) etching.

There are several additive metallizing methods:

a) selective conditioning of the plastic surfaces so that the adsorption of Pd/Sn colloids is influenced
b) precatalized polymeric materials
c) laser activation of a sensitized plastic d) masking or contact printing
e) Method Known from Patent Application WO2005035827 (abandoned)

Note: For methods c) and d) and partially a) a 1-component substrate may be used.

a) Selective Conditioning of Plastic Surfaces

In [1] it is described how it is tried to obtain selective metal deposition by giving two different plastics a surface treatment such that one plastic shows a strong absorption of the colloids and the other does not. This method only works with 100% selectivity in a very restricted number of cases. Almost always there is some metal deposition at the plastic not-to-be-metallized. Especially at micro applications, this is very critical and results very easily in short circuit in the electric circuit. Disclosure [7] describes the local activating of a hydrophobic plastic (one component) by means of a controlled plasma, where the surface activated by the plasma becomes strongly hydrophilic and thus shows a large affinity for forming of Pd nuclei.

b) Precatalized Polymers

In the past years, in view of MID and 2K injection moulding applications, different types of precatalized polymer granules have entered the market. Examples are Vectra 820i Pd of Ticona which comprises Pd particles and more recently Vestodur PBT of Degussa [2,3] which comprises an iron pigment that, after a chemical release, has the same catalyzing function as Pd for the electroless metallization process. Using such a precatalized polymer in combination with a non-precatalized polymer in a 2K injection moulding process, enables making a product that can be selectively metallized. Most important objections against these precatalized systems are both the high price and the fact that the quantity of catalytic material must be so high that it influences the properties and the processing of the polymer adversely. Besides, for the electroless metallization, use must be made of extremely active chemistry to start the metallization; in practice this means an unstable, very difficultly controllable metallization process.

c) Metallization of Plastics by Pattern with the Help of Laser

Recently, the German company LPKF has done a lot of work in developing a precatalized plastic with metal organic and metal oxidic additives which can be released by means of UV laser exposition, so that they become catalyticly active in the electroless metallization process. Thus, with the help of a UV laser, patterns can be written on a plastic carrier which can be metallized later [4,5]. This process is also called Laser Direct Structuring (LDS). Most important disadvantages are on the one side that the organo metal additives cannot resist the temperatures used for injection moulding of engineering plastics, and the fact that the quantity of catalytic material must be so high that it influences the properties and the processing of the polymer adversely.

d) Masking/Lithography/Contact Printing

Selective metallization is possible with use of masks; for 2D applications this is an obvious route, but 3D application masking techniques are often very complex. Application of patterns can be done in a subtractive way, i.e. first the complete product is metallized after which the metal layer is etched via a mask, resulting in the desired pattern. Besides, it is also possible to metallize additively. Special metallizable inks that are suitable to be metallized can be used in screen printing or contact printing processes [6]. Possibly, the mask can be optically created in a photo resist (not possible with more complex and 3D structures). Additionally, there is a recent development going on using a so-called active mask. In addition to galvanic techniques, vacuum techniques like PVD [7] may be used for metallization, which have, with regard to wet-chemical metallization, as their large disadvantage that they are affected by shadow effects making these techniques are less suitable for more complex 3D objects.

e) Method Known from Patent Application WO2005035827

The WO2005035827 method makes use of differences in chemical solubility between the used plastic types. The known method comprises a number of steps viz. etching, sensitizing, activating and covering the product completely with a "seed layer", comprising Pd nuclei. In the final preparation step the surface of the plastic not to be metallized is etched slightly, using a selective, not very aggressive etching agent, causing that the catalytic Pd nuclei at (only) that surface are removed. After this step the product is ready for electroless metallization of the nucleated components, viz. by exposing the whole product to a metallization environment, during which only the nucleated component(s) will be metallized.

The known method is applicable for a large number of combinations of plastics, viz. each combination for which a selective agent can be found which is—in the final preparation step—fit for "selective etching" the surface of the product, viz. by etching away the Pd nuclei layer at one of the two plastic components and, at the same time, leaving the Pd nuclei layer at the surface of the other component unaffected.

However, it appears that for high quality engineering plastics such as e.g. LCPs, PEEK, PPS, PPA in many cases no suitable selective etching agent can be found. These HQ engineering plastics—most interesting for application in electronic applications such as MIDs—excel by their high temperature stability (reflow solderable) and generally are chemically very resistant. Their surface may only be affected by strongly oxidizing acids. Due to that fact, however, when used in the process disclosed by WO2005035827, such strongly oxidizing acids are not suitable for selective etching in the final preparation step of the known process, because such strongly oxidizing agent will remove the catalytic Pd nuclei (the seed layer) from both plastic components instead of only from one of them. On the other hand, a less oxidizing agent will not work too as, due to the high chemical resistency of the HQ engineering plastics, such less oxidizing agents are not able to affect the (nucleated) surface of either the one or the other plastic component of the product. Resuming, no agents can be found which are suitable for selective etching in the final preparation step of the known process, while either both "seed layers"—serving as the basis of the subsequent metallizing step—will be destroyed or both surfaces, including their "seed layers", are not affected at all.

SUMMARY OF THE INVENTION

The novel method for metallizing a product which comprises a first and a second component aims to offer a solution in those cases that e.g. high quality engineering plastics are used for which, however, no suitable selective etching means can be found.

In a first aspect, the invention provides a method for the selective surface metallization of a product having a first surface of a first polymeric material, and a second surface of a second polymeric material, the method comprising the sequential steps of:

a) exposing said first and second surface to conditions which render the first surface hydrophilic or substantially compatible with water or aqueous solutions, and which render the second surface hydrophobic or substantially incompatible with water or aqueous solutions;

b) contacting said first and second surface with water or an aqueous solution;

c) contacting said first and second surface with a solution of a film former in a water-immiscible solvent, preferably an organic solvent d) evaporating said solvent to allow the formation of a film by said film former on said second surface, while the adherence of a film by said film former on said first surface is essentially prevented by the presence of the water or aqueous solution thereon, and optionally contacting said first and second surface with water or an aqueous solution to remove said film from said first surface;

e) performing a conventional metallization process to deposit a metal layer on said first and second surface, said process preferably involving a nucleation of said surfaces with catalytic nuclei, most preferably a Sn/Pd nucleation, in combination with electroless metallizing, and f) removing said metallized film from said second surface to render said first surface metallized.

In short, the method may be performed as follows.

A product (11) which comprises a first component (12), constituted by a first polymer material, and a second component (13), constituted by a second polymer material, is exposed to a first environment (14) wherein the surface of the first component becomes or remains hydrophilic, while the surface of the second component becomes or remains hydrophobic;

the product is subsequently contacted with water or a watery solution (15*a*);

the product is contacted with a solution (17*a*) of a film former in a solvent that is immiscible (does not mix or mixes badly) with water, and subsequently to a second environment (17*b*), wherein the organic solvent evaporates and a film (18) is formed covering the whole product, while maintaining the water under the film at the locations of the hydrophilic surface;

the product is rinsed out (17*c*), causing that the film is removed at the locations of the hydrophilic surface;

the product is nucleated by catalytic nuclei (19*a*), thus forming a nuclei layer (20) upon it, and subsequently the film is removed (19*b*) including the nuclei layer upon it, but leaving the nuclei layer at the hydrophilic surface of the first component.

In a first step the product is exposed to a first environment, wherein the surface of the first component becomes or remains hydrophilic, while the surface of the second component becomes or remains hydrophobic.

If the surfaces of both components are hydrophobic (the most common situation), the first environment preferably comprises an agent which is fit to cause that the surface of the first component becomes hydrophilic, while the surface of the second component remains hydrophobic.

However, if the surfaces of both components are hydrophilic, the first environment preferably comprises an agent which is fit to cause that the surface of the first component remains hydrophilic, while the surface of the second component becomes hydrophobic.

If the surfaces of the first component is hydrophilic, while the surface of the second component is hydrophobic, the first environment does not need any agent to modify the surface of either the first component or the second component from hydrophilic into hydrophobic or vice versa; in other words, in that case the first environment may be neutral in that sense.

Below it will be presumed that both, the first component and the second component have hydrophobic surfaces from nature or e.g. due to hydrophobic mould release agents, used during production of both components.

It is noted that, although no agents can be found which are suitable for selectively etching away the seed layer at the product's surface in the final preparation step of the known process, applicant now found that, surprisingly, agents can be found—also for HQ plastics—which are capable to selectively modify the surface affinity (attraction force) for e.g. water of the different product components, viz. to cause that the surface of one component becomes (or remains) hydrophilic, while the surface of the other component becomes (or remains) hydrophobic.

After this selection step, based on different surface energy behavior of the different plastics when exposed to the same agent, resulting in the first component having a hydrophilic surface and the second component having a hydrophobic surface—the entire product (or its relevant parts) is exposed to water or a watery solution, resulting in an all over water film. Subsequently, the water film can rather easily be removed from the hydrophobic surface of the second component while the water film remains at the hydrophilic surface of the first component.

Suitable surface materials include but are not limited to organic or inorganic (polymeric) materials. Preferably the surface are of a synthetic polymeric material. Preferred polymers are LCP (liquid crystalline polymers), PPA (polyphtalamide), PA (polyamid) types PA4,6 PA6T/x, PA 6/6T, PPS (polyphenylenesulphide), PES (polyethersulphone), SPS (syndiotactic polystyrene), PEI (polyetherimide), (modified) PPE (polyphenylenether), PBT (polybutyleneterephtalate), PC (polycarbonate), PC/ABS blends (polycarbonate/acrilonitrile-butadiene-styrene), ASA (acrylonitril-stryrol-acrylester), PP (polypropylene), PI (polyimid) and PEEK (polyetheretherketone). LCP, PPA and PA4,6 and PPS are most preferred. The weight average mean molecular weight of one segment in a segmented copolymer may be in the range from about 10 to about 500,000, preferably in the range from about 500 to about 25,000, more preferably in the range of about 100 to 5,000, particularly preferably in the range from about 500 to about 1,000.

Suitable film formers include for instance candellila wax, polydimethylsiloxane, stearic acid, parrafins, binolle or low molecular weight polymers of polyethylene or polyacrylate, and the like. The skilled person will be realize that the exact nature of the film former is irrelevant as long as it is capable of preventing the metallization of the hydrophobic second surface due to the fact that it is selectively retained at the hydrophobic second surface while it is washed away from the wetted hydrophilic first surface, and as long as it is capable of being removed from the second surface upon subjecting both (uncoated) first and (film coated) second surfaces to the metallization process.

As suitable (organic) solvents for the film former may be used toluene, dichloormethane, pentane, heptane, hexane, acetone, benzene, chloroform, methanol, xylene, ethylether, and the like.

In practice it is observed that when the product is taken out of the water and is introduced into the solvent, there is a danger that the water film on the hydrophilic surface does not stay intact, due to gravity forces, drying or local dewetting. For that reason it is preferred to expose the product to a water based viscous solution, resulting in a viscous water film remaining on the hydrophilic component which is far more stable. The viscous solution e.g. may be a solution of polyacrylic acid in water, to which salts (e.g. NaCl.) may be added to make it even more polar and increasing the wetting of the hydrophilic part.

In a subsequent step the product is exposed to a solution of a (more or less solid) film former in a (organic) solvent that is immiscible (does not mix or mixes badly) with water, and subsequently to an environment, e.g. air, gas or vacuum, wherein the solvent evaporates and a film is formed covering at least the first and second surfaces and optionally the whole product, while leaving the water film (only at the hydrophilic surface parts) intact under the film, e.g. maintaining a wetted hydrophilic surface.

Next, the product is rinsed out e.g. with water, causing that the film is removed at the locations of the hydrophilic surface of the first component due to the fact that—due to the presence of the water film—at those locations the film does not adhere to the component's surface.

As an additional preparation step—before the intended selective metallization—the product may be nucleated by catalytic nuclei, and subsequently the film is removed e.g. by means of an organic solution in which the film dissolves, including the layer of nuclei upon it, but with exception of the nuclei at the hydrophilic surface of the first component.

As a final step—after the final preparation step—the surface of the product may be exposed to a metallizing environment, causing metallization of the surface of the first component, which, after the various process steps, remained nucleated.

Besides the method for metallizing products, the invention, moreover, relates to products itself, viz. products comprising a first component, constituted by a first polymer material, and a second component, constituted by a second polymer material, of which products the surface of said first component is metallized or prepared for metallization using the method as outlined above.

Both polymer components or either component may be made of a thermosetting or a thermoplastic polymer material or of an elastomer.

The new method has a number of advantages with regard to the prior art methods. With regard to laser structures (c) and masking techniques (d), it has as the advantage that products can be processed batch wise and the structuring has not to be done at each product separately. With regard to patent WO2005035827 (e) it has as advantage that another group of plastics can be treated. This group comprises many plastics from the group of HQ engineering plastics such as LCP, PPA and PPS, which are, from application point of view, very interesting. With regard to method (b), in which precatalized substrates are used, besides the advantages of the lower costs of material as well as the retention of the mechanical properties of the polymer material, the large advantage is that the way of processing can be much more robust. The use of precatalized polymers requires a very active, but also unstable metallization chemistry which is very difficult to control and which has a very narrow process window.

The new method on the other hand works with standard stable electroless metallization chemistry. The selectivity of the metallization is in principle larger than which can be reached by techniques (a), (b) and (c). The suitability for 3D patronizing is superior to that of methods (c) and (d). Metal patterns can be applied both at the surface and throughout the product (incl. through-holes, blind holes)

Below the invention will be illustrated with an exemplary embodiment.

EXEMPLARY EMBODIMENT

Figure 1:
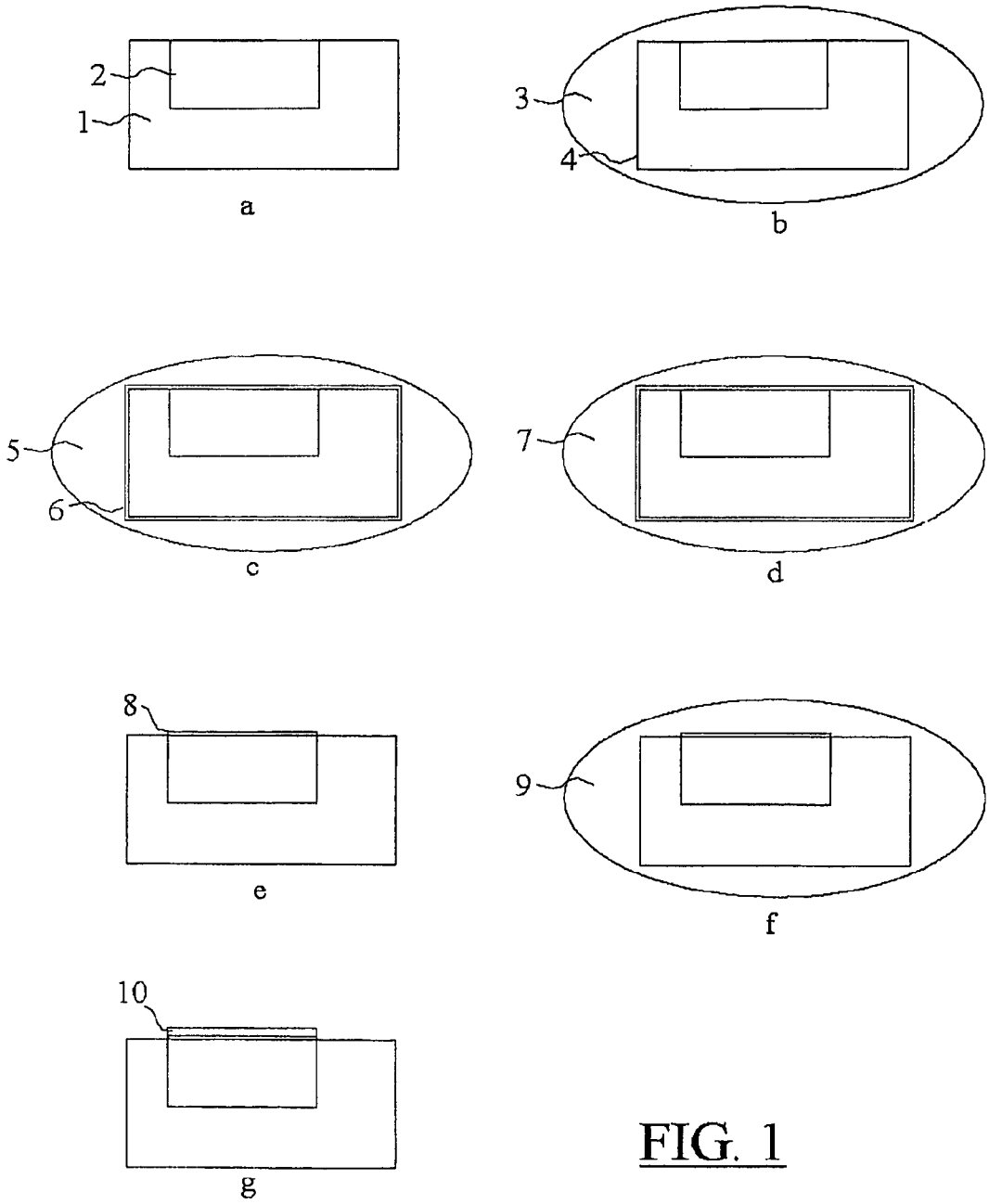
FIG. 1 shows schematically the prior art method, known from WO2005035827, in several stages.

Derived from WO2005035827, FIGS. 1*a-g* illustrate schematically the prior art metallizing process of a component with two parts made of different polymer materials, in which FIG. 1*a* shows a component, consisting a first component part 1, made of a first polymer material e.g. polymer, and a second component part 2, made of a second polymer material e.g. polymer. FIG. 1*b* illustrates that the whole component is exposed to an activating or etching environment 3 (e.g. an etching bath) to get a hydrophilic and roughened surface 4 for good bonding properties. It is emphasized that in this prior art method both, the surface of component 1 and the surface of component 2 are deemed to become affected by the etching environment, due to which the surface of both components will become hydrophilic.

FIG. 1*c* shows that the component surface 4 is—in a processing environment 5—"sensitized" for metallizing, e.g. by adsorption of Sn ions to the surface and subsequent activation, e.g. by reduction of Pd ions to metallic Pd by means of said Sn ions, resulting in a metallizing seed (or nuclei) layer 6. FIG. 1*d* shows that, subsequently, the surface of the component, including the seed layer 6, is exposed to a solvent 7, in which the surface of said first component part 1 is soluble but the surface of the second component part 2 is not. The surface of component part 1, including the seed layer 6 upon it, will thus be solved in (or etched by) the solvent 7 after which the residue can be removed.

FIG. 1*e* shows that the metallizing seed layer 6 only stays at the surface of the second component part 2, represented by a partial seed layer 8. FIG. 1*f* shows that, after exposure of the (whole) component to a metallizing environment 9, only component part 2, covered by the partial seed layer 8, will be metallized—represented by metal layer 10—due to the absence of the seed layer at the first component part 1 and the presence of it at part 2. The metallizing environment 9 may be based on of catalytic reduction of a metal coating (e.g. Cu or Ni) applied upon the seed layer 8 from a solution comprising both the relevant coating metal ions and a reduction chemical.

The result of the final metallizing process, represented by FIG. 1*g*, is a two-part component, of which only one part, viz. part 2, is covered by metal layer 10, while the other part, part 1, remains un-covered, due to the absence of the metallizing seed layer 6, which was solved by the "discriminating" solvent 7 (FIG. 1*d*).

Figure 2:
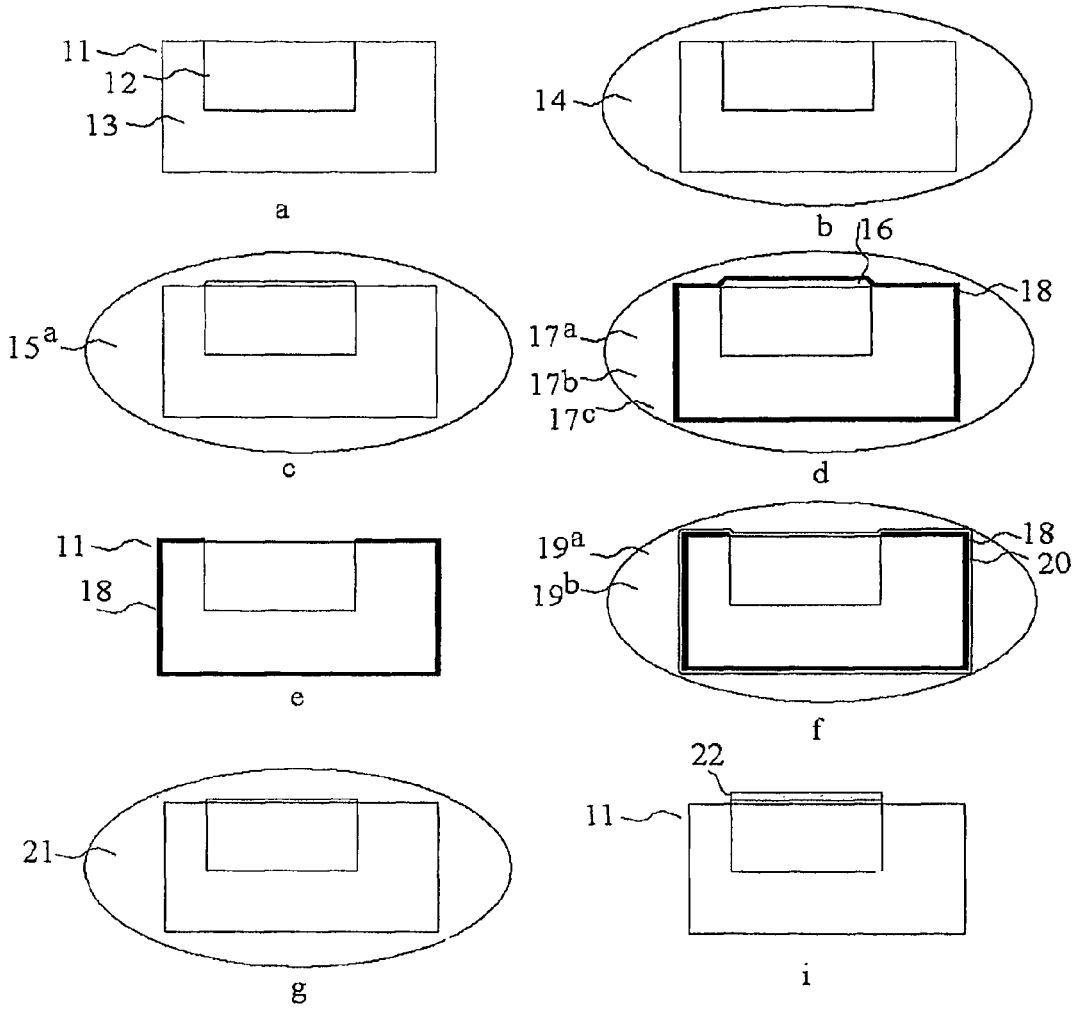
FIG. 2 shows schematically an embodiment of the novel method as outlined above in several stages.

FIG. 2 illustrates the novel method for metallizing a product 11 which comprises—shown in FIG. 1*a*—a first component 12, constituted by a first polymer material, and a second component 13, constituted by a second polymer material. Both materials e.g. are HQ plastics or ceramics which may not fit for the prior art partial metallizing method.

FIG. 2*b* shows that the product is exposed to a first environment 14 wherein the surface of the first component becomes or remains hydrophilic, while the surface of the second component becomes or remains hydrophobic. When the surfaces of both components are hydrophobic the first environment 14 comprises an agent which is fit to cause that the first component 12 becomes hydrophilic, while the surface of the second component 13 remains hydrophobic. When the surface of the components 12 and 13 both are hydrophilic (e.g. from nature or made so in a preprocessing stage) the first environment comprises an agent which is fit to cause that the first component 12 remains hydrophilic, while the surface of the second component 13 becomes hydrophobic.

When the surface of the first component already would be hydrophilic and the surface of the second component hydrophobic, e.g. from nature or resulting from the previous manufacturing process or made so in a previous process, the first environment 14 can be neutral, causing that the surface of the first component remains hydrophilic and the surface of the second component hydrophobic. In that case the step shown in FIG. 2*b* might be skipped.

So, in each case the surface of the first component 12 is (made) hydrophilic and the surface of the second component 13 is (made) hydrophobic.

Next, —shown in FIG. 2*c*—the product is exposed to water or a watery solution 15*a*

Subsequently—shown in FIG. 2*d*—the product 11 is exposed to a solution of a film former in an organic solvent 17*a* that mixes badly with water and thus pushing away the water film at the hydrophobic surface of the second component 13 while leaving the water film at the first component's surface. Subsequently the product 11 is exposed to a second environment 17*b*, wherein the solvent evaporates and a more or less solid coating or film 18—e.g. comprising a wax or a low molecular polymer—is formed out of the film former solution, which film 18 will cover the whole product, while maintaining the (partial) water film 16 under the it, viz. at the hydrophobic location(s).

After that the product is rinsed out by water (17*c*), causing that the film is removed at the locations of the hydrophilic surface of the first component. The result of the process steps of FIG. 2*d* is shown in FIG. 2*e*, viz. the product 11, enveloped by the film 18 at its hydrophobic surface part(s) and leaving the hydrophilic surface part(s) free, thus enabling nucleation of that free surface(s) as illustrated in FIG. 2*f*.

FIG. 2*f* shows how the product is nucleated in an environment 19*a* comprising catalytic nuclei, resulting in a nuclei layer 20 all over the whole surface of the product. Subsequently the (partially covering) film 18 is removed including the nuclei layer 19 upon it by exposing the product 11 to a solvent 21 in which the temporary film 18 dissolves, but leaving the nuclei layer 19 at the hydrophilic surface of the first component 12.

Finally, the above preparation steps are followed by a step wherein—illustrated in FIG. 2*g*—the surface of the product 11 is exposed to a metallizing environment 21, causing the metallization of only the (nucleated) surface of the first component 12, resulting in the partly metallized product as shown in FIG. 2*i*, comprising the components 12 and 13, of which only component 12 is provided with a metallized surface 22.

Finally two detailed examples will be given:

EXAMPLE #1

LCP/PPS

This example describes the selective metallization of a part comprised of 2 different plastics: liquid crystalline polymer (LCP) Vectra 820i, supplied by Ticona company, and polyphenylenesulphide (PPS); type for instance Ryton R-7 or Ryton BR111 BL-S, supplied by Philips Chevron Chemical Company. Execution of the following steps leads to a selective metallization of the LCP surface while the PPS surface remains free from metal.

An injection moulded 2-component part of these materials is processed as follows:

1. Alkaline etching in e.g. MID Select 9020 (supplied by Cookson Electronics company) for 5 minutes at T=80° C. This leads to a hydrophilic LCP surface while the PPS surface remains hydrophobic.
2. Hot water rinse T=75° C. for 1 minute followed by a short cold rinse in pure water.
3. Part is immersed in a 4 wt % solution of sodium salt of polyacrylic acid ($M_w$=1200 g $mol^{-1}$) plus 1 g $l^{-1}$ NaCl for 5 to 10 seconds under stirring. This helps in preventing the acrylate solution that is applied in step 4 from wetting the LCP and moreover helps in replacement of the water phase by the organic acrylate phase from the PPS surface.

4. The part is immersed in a solution of an acrylic polymer in an organic solvent, e.g. NeoCryl type B725, B735, B736 (DSM company), with a concentration of 5 wt % at room temperature for 2 seconds. Solvent is dichloromethane or toluene.
5. The part is removed from the acrylic polymer solution and allowed to dry in the ambient air for about 30 to 60 seconds.
6. The part is rinsed under vigorous stirring in pure water for about 30 seconds to remove the acrylic polymer from the LCP surface
7. The part is immersed into a sensitizing solution e.g. consisting of 10 g $l^{-1}$ $SnCl_2.2H_2O$ plus 40 ml $l^{-1}$ HCl for 2 minutes at room temperature
8. The part is rinsed in pure water for 30 seconds
9. The part is immersed into an activation solution e.g. consisting of 0.25 g $l^{-1}$ $PdCl_2$ plus 2.5 ml $l^{-1}$ HCl for 1 minute at room temperature
10. The part is rinsed in pure water for 30 seconds
11. The part is rinsed in an organic solvent, for instance acetone for 30 seconds, to remove the acrylate film together with the Pd nuclei from the PPS
12. The part is rinsed in pure water for 30 seconds
13. The part is metallized in a conventional electroless plating solution e.g. electroless nickel Enplate EN 435E (supplied by Cookson Electronics company)

A selective metallization of the LCP surface is thus obtained

EXAMPLE #2

PA4,6/PPA

This example describes the selective metallization of a part comprised of 2 different plastics: polyamide 4,6 with tradename Stanyl TE200 F6, supplied by DSM company (PA4,6), and polyphtalamide Amodel AS4133HS NT, supplied by Solvay Advanced Polymers company (PPA). Execution of the following steps leads to a selective metallization of the PA 4,6 surface while the PPA surface remains free from metal.

An injection moulded 2-component part of these materials is processed as follows:

1. The part is immersed in a solution of 100 g $l^{-1}$ HCl at room temperature for 2 minutes. This renders the polyamide 4,6 surface hydrophilic while the PPA surface remains hydrophobic
2. The part is shortly rinsed with pure water
3. Further processing is identical to steps 3 to 13 of example #1

REFERENCES

[1] Verbundfestigkeit von Thermoplasten bei der Zwei-Komponenten-MID-Technik fur miniaturisierte Mikrosystemgehause, Abschlussbericht FV-Nr. 12120N, Hahn-Schickard-Gesellschaft Institut fur Mikroaufbautechnik (2001)

[2] Degussa product leaflet vestodur (2002)

[3] MIDteilungen, 10 (1999) 2

[4] G. Naundorf, H. Wissbrock, A fundamentally new mechanism for additive metallization of polymeric substrates in ultra fine line technology illustrated for 3D-MIDs, Galvanotechnik, 91, (2000) 9

[5] M. Huske et al., Laser supported activation and additive metallization of thermoplastics for 3D-MIDs, Proc. 3rd LANE 2001, Erlangen (2001)

[6] zie bijvoorbeeld www.metallization.com/selective

[7] M. Thomas, Fachzeitschrift PLUS Produktion von Leiterplatten and Systemen, 6 (2005); http://www.leuze-verlag.de/plus/verband/3-d-mid/inh_3dmid.asp

The invention claimed is:

1. Method for the selective surface metallization of a product having a first surface of a first polymeric material, and a second surface of a second polymeric material, the method comprising the sequential steps of:

a) exposing said first and second surfaces to conditions which render the first surface hydrophilic, and which render the second surface hydrophobic;
b) contacting said first and second surface with water or an aqueous solution;
c) contacting said first and second surface with a solution of a film former in a water-immiscible organic solvent;
d) evaporating said solvent to allow the formation of a film by said film former on said second surface, while the adherence of a film by said film former on said first surface is essentially prevented by the presence of water or aqueous solution thereon, and optionally contacting said first and second surfaces with water or an aqueous solution to remove said film from said first surface;
e) performing a metallization process to deposit a metal layer on said first and second surfaces, and
f) removing said metallized film from said second surface to render said first surface metallized.

2. Method according to claim 1, wherein the first surface and the second surface are hydrophobic and wherein the exposure in step a) comprises contacting said first and second surface with an agent which causes the first surface to becomes hydrophilic and the second surface to remain hydrophobic.

3. Method according to claim 1, wherein the first surface and the second surface are hydrophilic and wherein the exposure in step a) comprises contacting said first and second surface with an agent which causes the first surface to remain hydrophilic and the second surface to become hydrophobic.

4. Product comprising a first component, comprising a first polymer material, and a second component, comprising a second polymer material, the surface of said first component comprising a metallized layer resulting from the method according to claim 1.

5. Product comprising a first component, comprising a first polymer material, and a second component, comprising a second polymer material, the surface of said first component comprising a metallized layer resulting from the method according to claim 2.

6. Product comprising a first component, comprising a first polymer material, and a second component, comprising a second polymer material, the surface of said first component comprising a metallized layer resulting from the method according to claim 3.

7. The method of claim 1, wherein the metallization process of step e) comprises nucleation of said surfaces with catalytic nuclei.

8. The method of claim 7, wherein the nucleation is Sn/Pd nucleation.

9. The method of claim 7, wherein the metallization process of step e) comprises electroless metallizing.

* * * * *